US006199469B1

(12) United States Patent
Nystrom

(10) Patent No.: US 6,199,469 B1
(45) Date of Patent: Mar. 13, 2001

(54) COUNTERBALANCE WEIGHT DEVICE

(75) Inventor: Robert E. Nystrom, Woodbridge, VA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/342,919

(22) Filed: Jun. 30, 1999

Related U.S. Application Data

(66) Substitute for application No. 08/958,189 on Oct. 27, 1997, now abandoned, which is a substitute for application No. 08/746,523 on Nov. 12, 1996, now abandoned.

(51) Int. Cl.[7] ..... F41A 27/30
(52) U.S. Cl. ..... 89/37.08; 89/1.816
(58) Field of Search ..... 89/37.07, 37.08, 89/1.816

(56) References Cited

U.S. PATENT DOCUMENTS

| | | | | |
|---|---|---|---|---|
| 2,389,726 | * | 11/1945 | Goodhue | 89/37.08 |
| 2,415,340 | * | 2/1947 | D'Ardenne et al. | 89/37.08 |
| 4,452,124 | * | 6/1984 | Morenus et al. | 89/1.816 |
| 5,062,347 | * | 11/1991 | Allais et al. | 89/37.07 |

FOREIGN PATENT DOCUMENTS

| | | | | |
|---|---|---|---|---|
| 174964 | * | 2/1922 | (GB) | 89/37.08 |
| 316020 | * | 3/1934 | (IT) | 89/37.08 |

* cited by examiner

*Primary Examiner*—Stephen M. Johnson
(74) *Attorney, Agent, or Firm*—Milton W. Lee; John E. Holford; Alain L. Bashore

(57) ABSTRACT

A device for weight counterbalance of compensating equilibrators of a TOW weapons system substituted in place of a launch tube. A ballast weight rest on a platform and further includes a centering element, with support and bracing structure, so that the device is releasably coupled to an existing missile launch tube interface of the TOW.

2 Claims, 8 Drawing Sheets

COUNTERBALANCE WEIGHT DEVICE

RELATED APPLICATION

This is a substitute application for patent application Ser. No. 08/958,189 filed Oct. 27, 1997, now abandoned, which is a substitute application for patent application Ser. No. 08/746,523 filed Nov. 12, 1996, now abandoned.

The invention described herein may be manufactured, used, and licensed by the U.S. Government for governmental purposes without the payment of any royalties thereon.

BACKGROUND OF THE INVENTION

1. Field of the Invention

The present invention generally relates to counterbalance weight devices and more specifically, to a counterbalance weight device which allows for the use of the viewing or sensing equipment on the TOW weapons system without use of an installed launch tube, but using a pre-existing interface.

2. Description of Prior Art

TOW (tube launched optically tracked, wire command, link guided) is an assault missile weapon system capable of accurate, effective fire against armored vehicles and hard targets. Several versions of the system is in existence, including vehicle mounted and ground mounted configurations. On several past occasions TOW weapon systems have been and are now presently being deployed in the ground mounted configuration as a platform for observation and surveillance in non-hostile, but highly sensitive, areas of operations.

When used for observation and surveillance purposes, the system still requires the installation of the Launch Tube to aid in the ease of mechanical operation. Unfortunately, when the system is deployed and the Launch Tube installed, it has been interpreted as a hostile or threatening action which has provoked unwanted reactions. Without the launch tube in place, only the very strongest of men can overcome a strong equilibrator action inherent to the system, and then only for a very short time because of the continuous strain of holding against the strong spring action.

While the prior art has reported using a TOW system none have established a basis for a specific apparatus that is dedicated to the task of resolving the particular problem at hand. What is needed in this instance is a counterbalance weight device which allows for the use of the viewing or sensing equipment on the TOW weapons system without use of an installed launch tube.

SUMMARY OF THE INVENTION

It is therefore one object of the invention to provide a counterbalance weight device which allows for the use of the viewing or sensing equipment on the TOW weapons system without use of an installed launch tube.

According to the invention, there is disclosed a device for weight counterbalance of compensating equilibrators of a TOW weapons system. The TOW weapons system includes a missile launch tube interface further including launch tube brackets, locating pin, and launch tube latch for releasably coupling a launch tube to the missile launch tube interface.

The device includes a means provides ballast weight which rests upon a platform. Two platform support beams are coupled along their lengths to the platform bottom for support of said platform and coupled at one end to support beams. Platform braces are each coupled at one end to opposite platform sides and at each other end to a frame support bar, for bracing the platform. Two support beams couple and vertically support the platform support beams end and a frame support bar. A frame support bar with two ends is coupled perpendicular along its length to the platform braces other ends and the support beam for releasably coupling the frame support bar ends to the launch tube brackets.

A centering element coupled to the support beams other ends for insertion of the locating pin therethrough the centering element to be releasably coupled to the latch. Upon removal of the launch tube, the device is releasably coupled to the missile launch tube interface such that there is weight counterbalance of the compensating equilibrators.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

The preferred embodiment for use in describing the operation of the invention is the TOW AN/TAS-4. Any version of the TOW may be utilized in the practice of the present invention. It is understood that the invention is also not limited to any particular type of viewing or sensing equipment (either now available or available in the future) on the TOW.

Figure 1:
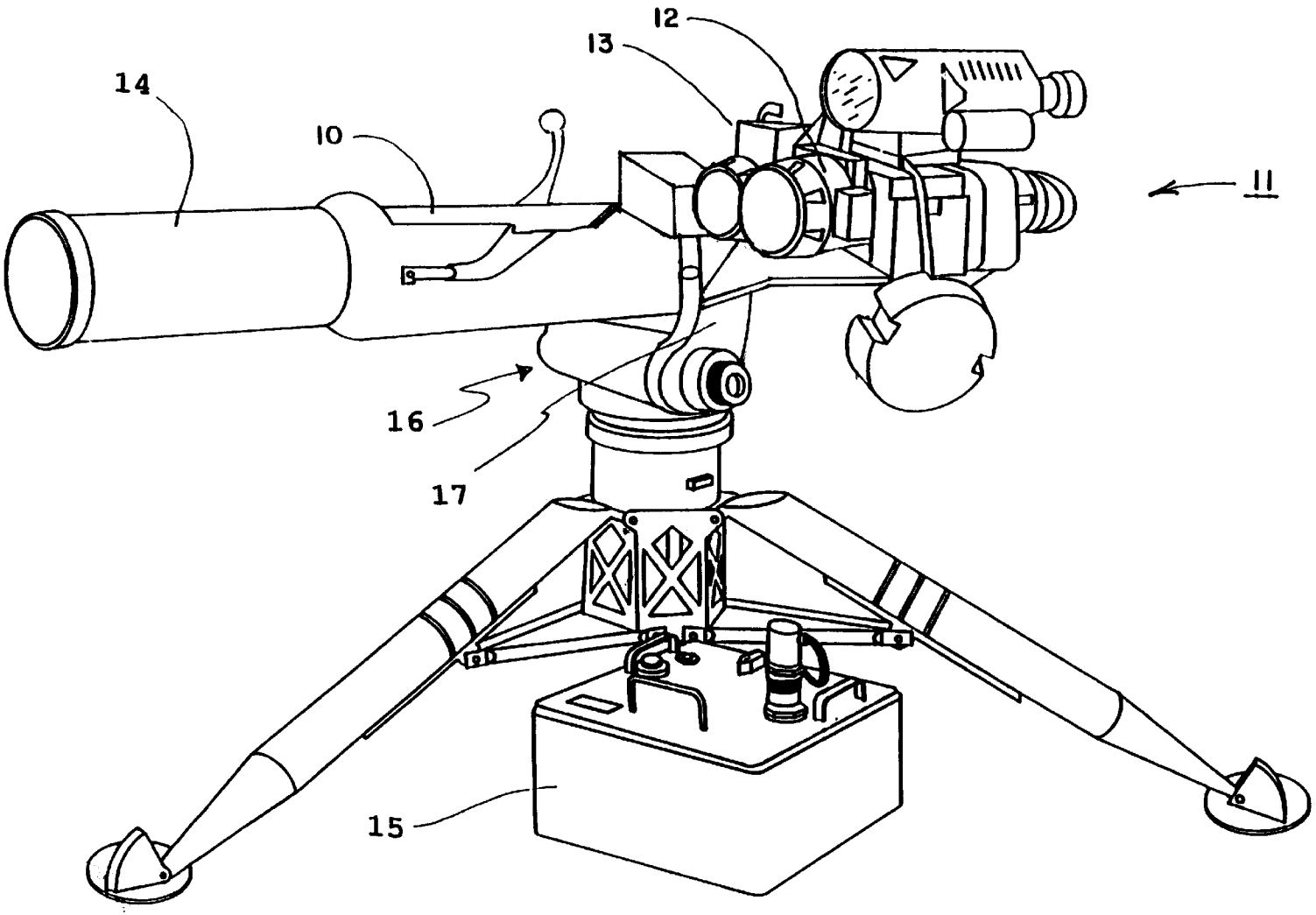
FIG. 1 is a profile view of a TOW missile system.

Referring now to the drawings, and more particularly to FIG. 1, there is shown a profile view of the presently fielded TOW AN/TAS-4. A TOW missile (not shown) is encased in disposable sealed launcher container 10 which acts as a protective container and as the breech end of system 11. Traverse head assembly 16, including main vertical frame 17, mechanically mates on top of the tripod leg assembly and electrically, by cable, with guidance set 15. Visible optical system 12 mechanically and electrically mates directly to a left side of traverse head assembly 16. Near IR tracker optical system 13 mechanically couples to the top of visible optical system 12 and electrically, by cable, with traverse unit 16. Launcher tube 14 mechanically mates to the front of traverse unit 16.

An operator looks through visible optical system 12 and acquires the target within a visible optical axis. Launcher tube 14 which provides an exit for the missile from launcher container 10 is thus in initial alignment with the target. Upon achieving target alignment, the operator fires the missile by manually depressing an electrical trigger switch. The flight path of the missile is controlled via guidance signals sent by guidance set 15 transmitted over a wire link which connects the in flight missile with the launcher. The operator's task after firing the missile is to maintain alignment of the target on the sight reticule of visible optical system 12 until missile impact. Deviations of the missile from the intended trajectory are sensed by the near IR tracker optical system 13. Traverse head assembly 16 provides the weapon with a very stable and balanced missile launching and tracking platform when fully configured (with launch tube in place).

The weapon, when missile and launch tube installed, becomes overbalanced to the front (front heavy). This overbalance is canceled by the action of very stout spring loaded compensating equilibrators, located in traverse head assembly 16. The equilibrator weight compensation provides an adequate mechanical advantage to balance the load and enable the gunner to easily maneuver the weapon in the vertical plane. When the weapon is not loaded, (missile and launch tube not installed), traverse head assembly 16 is continually driven by equilibrator springs, to be back heavy. Platform stability is achieved by use of Viscous-Drag type accelerometers, located in traverse head assembly 16, to provide for tracking slew rate data for missile guidance and prevention of over-corrective actions by the operator, in both vertical and horizontal planes which could break the track link.

Figure 2:
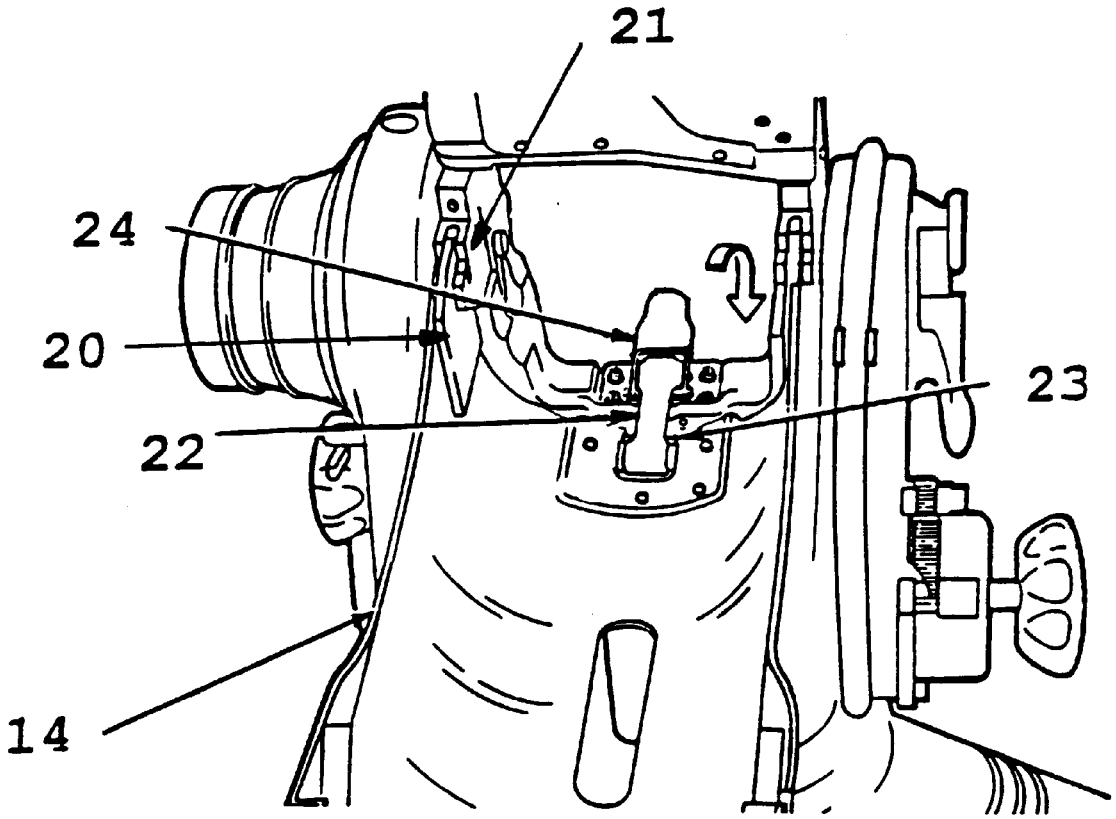
FIG. 2 is a perspective cut-a-way view of the missile launch tube interface unit of the TOW missile system of FIG. 1.

FIG. 2 shows the missile launch tube interface of launch tube 14 and of traverse head assembly 16 of FIG. 1. Launch tube 14 has at its end launch tube index lugs 20 which couple onto launch tube brackets 21 so as to fixedly place launch tube 14 on traverse head assembly 16. As launch tube 14 is fixedly placed, locating pin 22 of traverse head assembly 16 is brought through mating hole 23 located on launch tube 14. Locating pin 22 is then coupled by launch tube latch 24 .

Figure 3:
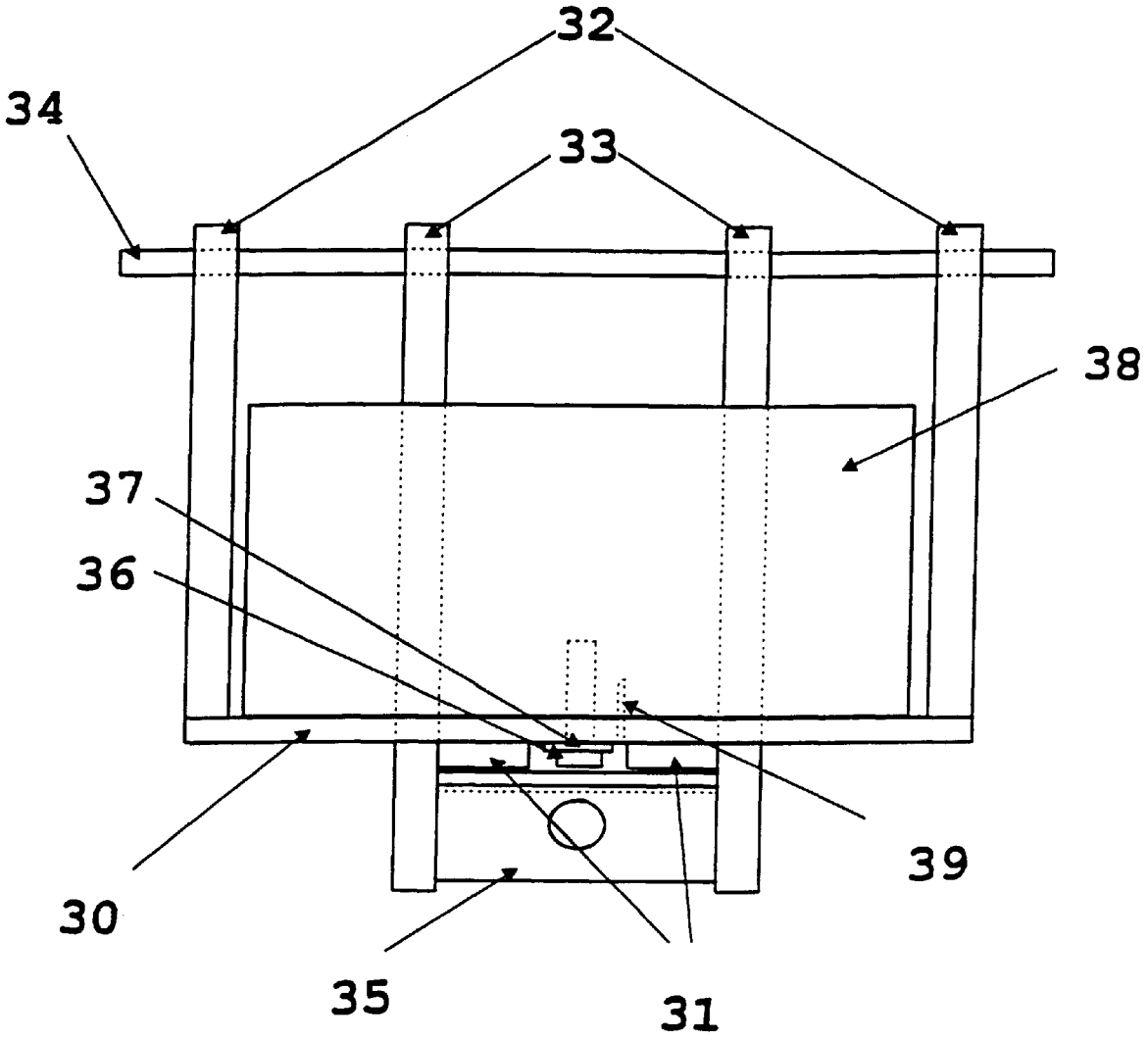
FIG. 3 is a front view of the invention.
Figure 4:
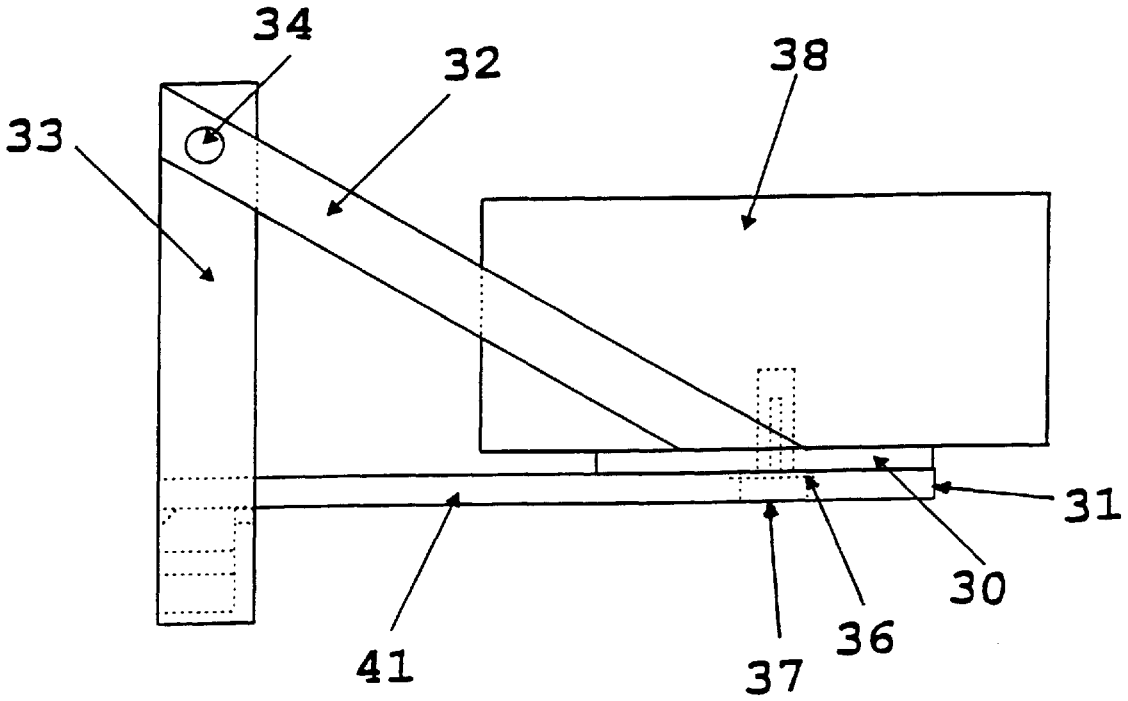
FIG. 4 is a right side view of FIG. 3.
Figure 5:
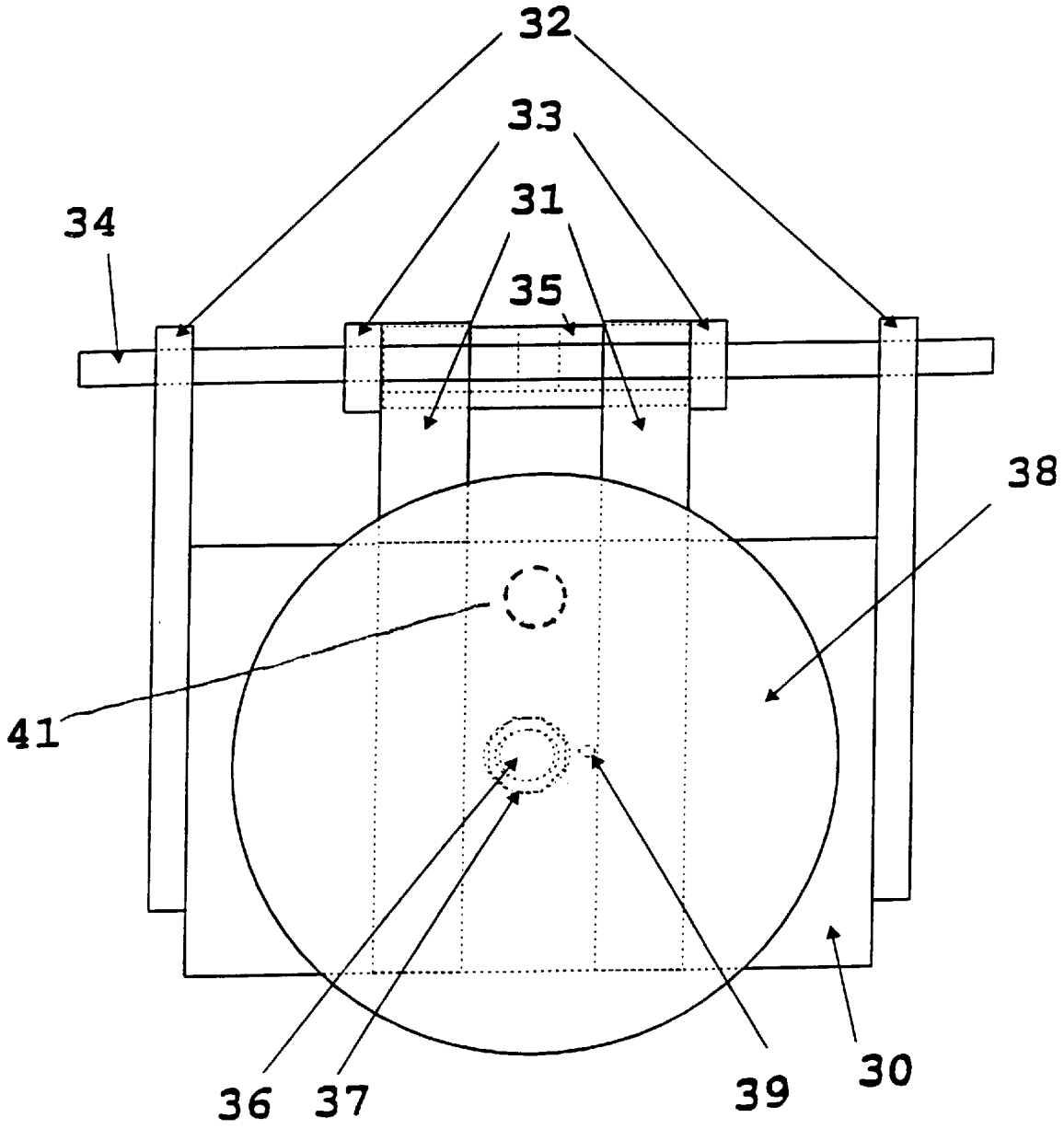
FIG. 5 is a top view of FIG. 3.

FIGS. 3, 4 and 5 shows front, right side, and top views respectfully of the present invention. An aluminum framework structure is utilized, comprised of one weight platform 30, two lower platform support beams 31, two outer platform braces 32, two rear support beams 33, one frame support bar 34, and one centering block 35. The retaining bolt 36 and lock washer 37 are used to attaches the ballast weight 38 to the framework. Locking pin 39 assures that ballast weight 38 will not spin and come loose from the framework. As seen in FIG. 4, outer platform braces 32 are positioned at an angle 40, with attachment to a position of lateral center of gravity for weight 38. Alternate retaining hole 41 allows for an alternate placement of ballast weight 38 along weight platform 30. An alternate placement is needed for possible use on different TOW versions which may have (either now or in future versions) other equipment and thus a different center of gravity than the presently fielded TOW AN/TAS-4. FIG. 5 depicts ballast weight 38 as circular in configuration. It is understood that the invention is not limited to a particular shape, but that any shape may be used as the ballast weight.

Figure 6:
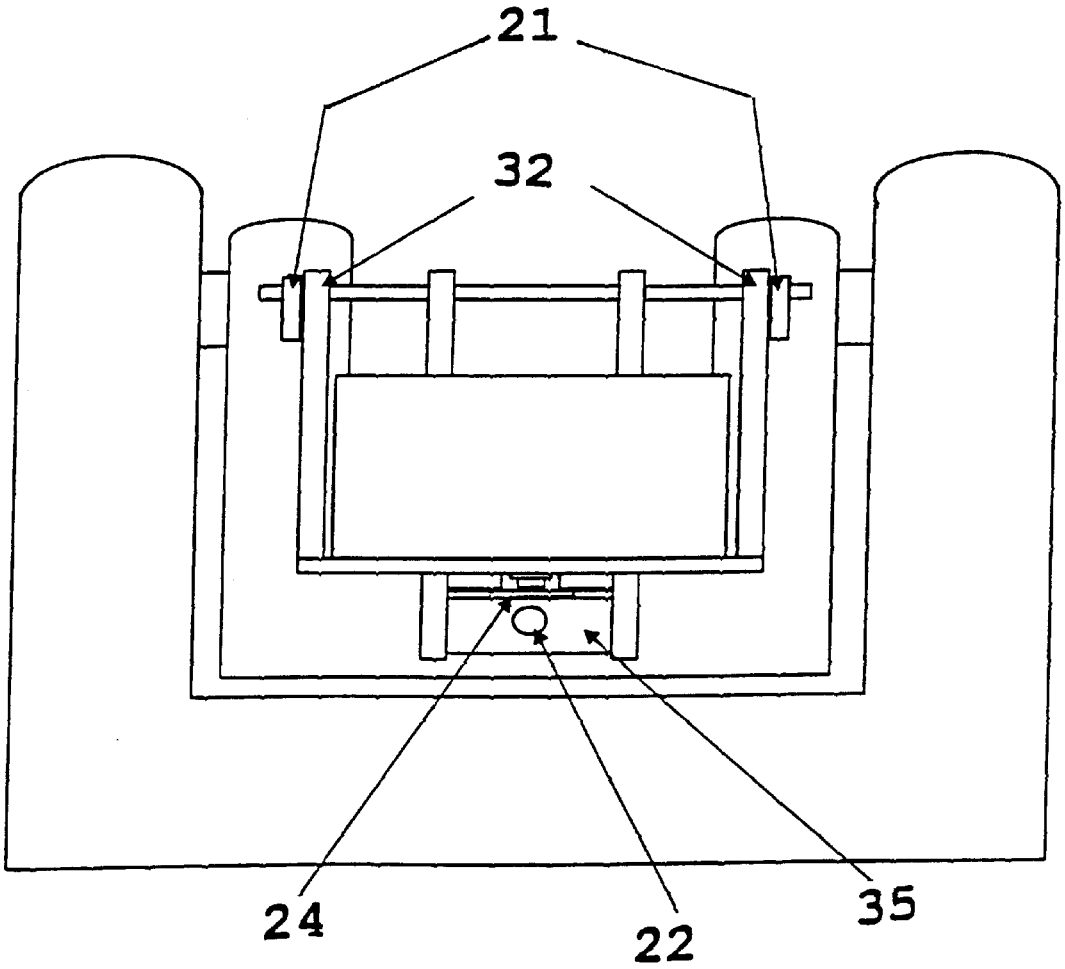
FIG. 6 is a front view of the TOW weapon cradle assembly utilizing the present invention.
Figure 7:
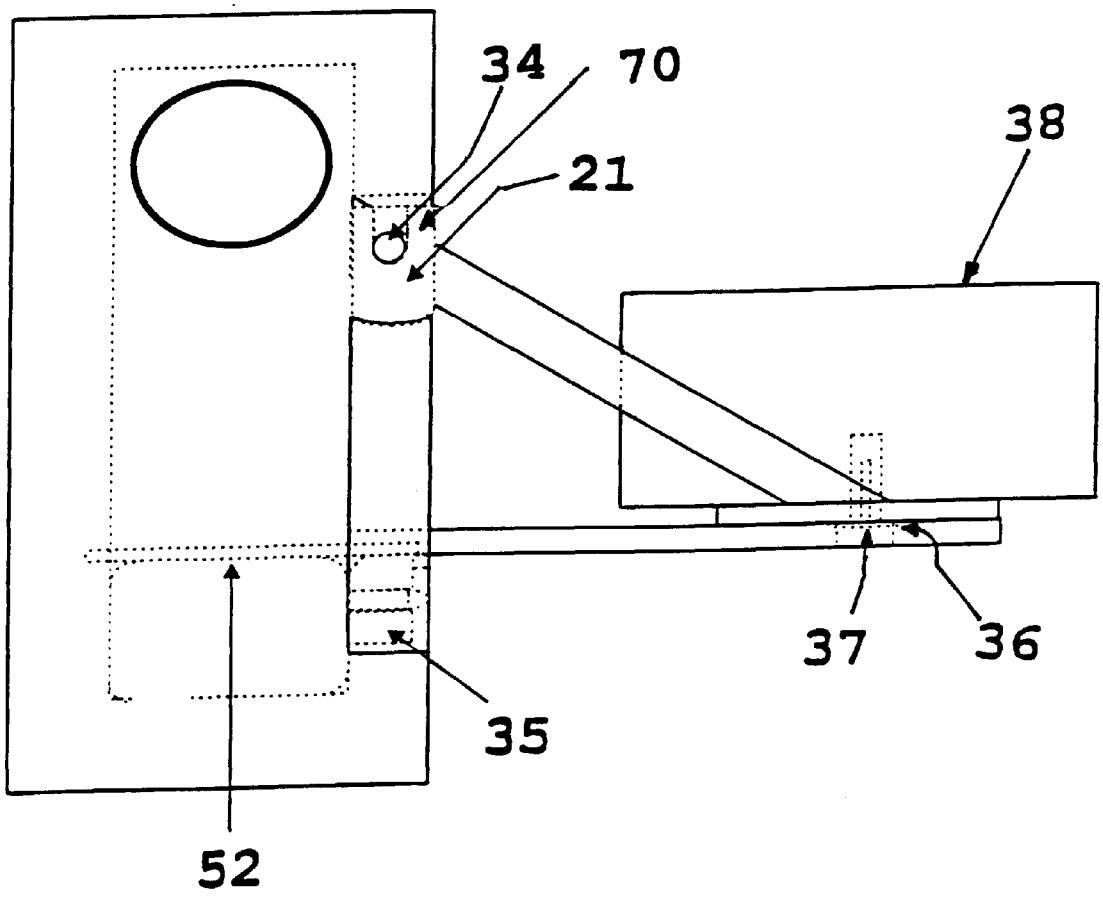
FIG. 7 is a right side view of FIG. 6.

FIGS. 6 and 7 are front and right side views of the TOW weapon cradle assembly utilizing the present invention. As shown in FIG. 6, upper ends of outer braces 32 are positioned in-between launch tube brackets 21, and locating pin 22 is positioned through centering block 35 with launch tube latch 24 in place. Frame support bar 34 is place within bracket ends 70 of launch tube brackets 21, as shown in FIG. 7.

Figure 8:
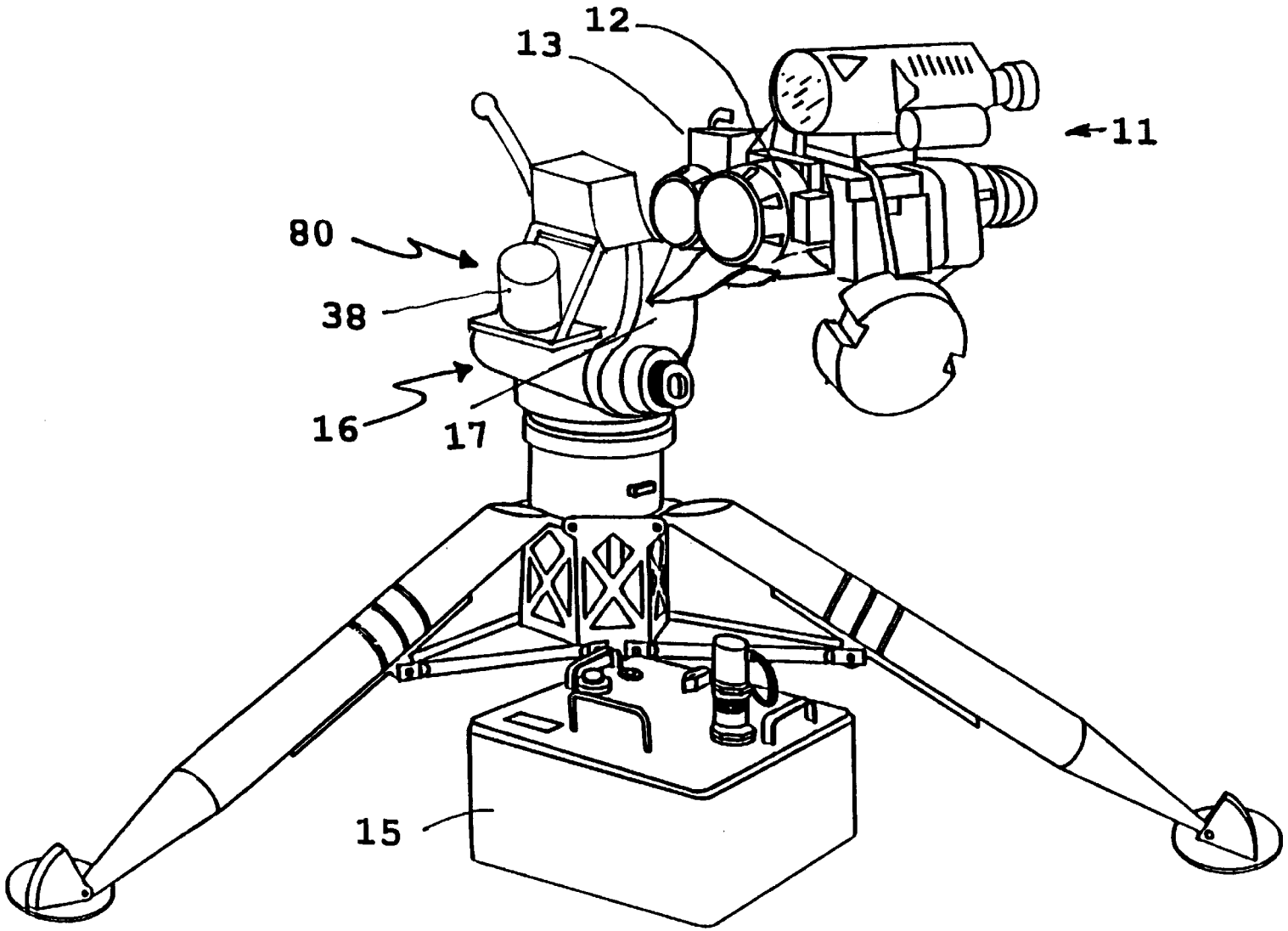
FIG. 8 is a profile view of the TOW missile system of FIG. 1 with launch tube removed and utilizing the present invention.

FIG. 8 is a profile view of the TOW missile system of FIG. 1 utilizing counterbalance weight device 80. Device 80 functions to counterbalance the equilibrator action to enable ease in vertical stewing movements of the TOW weapon. Device 80 mechanically interfaces directly with the traverse head assembly 16 using the same surfaces used with launcher tube 14. When properly attached to traverse head assembly 16, device 80 accurately positions weight 38 to function as a counterbalance weight/ballast to overcome the equilabrator action of traverse head assembly 16.

The device of the preferred embodiment is constructed of a basic frame aluminum weldment using common flat stock material and a steel mass ballast weight. Width and height dimensions of the basic frame are determined and governed by the Launch Tube mechanical interface with traverse head assembly 16. The physical size of weight 28 is dependent on the type of and the shape of the selected material. It is understood that the invention is not limited to a particular type or shape of material selected as the weight. For example, if a cube shape of a 487.7 pounds per cubic feet (lbs/ft$^3$) steel is used as the weight material, the block would be 6 inches wide by 4 inches deep by 4.725 inches high (6.000"×4.000"×4.725"). If the same material is used in a cylindrical shape with a 5.0" diameter, the height is 5.775" or with a 6.0" diameter, the height is 4.010". The device's weight in the preferred embodiment is divided between the aluminum structure of approximately two (2) pounds and steel weight of thirty-two (32) pounds for an overall weight of approximately 34 pounds. The weight can be marked, for operation and safety purposes, on the weight itself.

While this invention has been described in terms of preferred embodiment consisting of use in a TOW weapons system model TOW AN/TAS-4, those skilled in the art will recognize that the invention can be practiced with modification within the spirit and scope of the appended claims.

Having thus described my invention, what I claim as new and desire to secure by Letters Patent is as follows:

1. device for weight counterbalance of compensating equilibrators of a tube launched optically tracked, wire command, link guided weapons system wherein the weapons system includes a missile launch tube interface further including launch tube brackets, locating pin, and launch tube latch for releasably coupling a launch tube to the missile launch tube interface, the device comprising:

means for providing ballast weight;

platform with side surface, top surface, and a bottom surface, the platform for providing a horizontal surface upon which rests said means for providing ballast weight;

two platform support beams each with first and second platform support beam ends, each platform support beam coupled to the platform bottom for support of said platform and each second platform beam end coupled to each of two support beams;

two platform braces each with first and second platform brace ends coupled at each first platform brace end to separate portions of the platform sides and the second platform brace end to second support beam ends for bracing said platform;

two support beams each with first and second support beam ends, for coupling each first support beam end of the two support beams to each second platform support beam end and supporting each platform support beam, and said second support beam end coupled at each second platform brace end;

frame support bar with first and second frame support bar ends, the frame support bar coupled along its length to the second platform brace ends and second support beam ends, the frame support bar for releasably coupling approximate to each of the first and second frame support bar ends to the launch tube brackets, and;

centering element coupled to both platform support beams for releasable coupling of the device to the locating pin, whereby the device is substituted for the launch tube by releasably coupling the device to the missile launch tube interface such that there is weight counterbalance of the compensating equilibrators.

2. The device of claim 1, wherein said means for providing ballast weight is a cylinderically shaped steel mass.

* * * * *